US011885143B2

(12) United States Patent
Thompson

(10) Patent No.: US 11,885,143 B2
(45) Date of Patent: Jan. 30, 2024

(54) OVAL COVER MEMBER FOR PRE-CAST CONCRETE LIFT HOOK

(71) Applicant: Harry A. Thompson, Wyomissing, PA (US)

(72) Inventor: Harry A. Thompson, Wyomissing, PA (US)

( * ) Notice: Subject to any disclaimer, the term of this patent is extended or adjusted under 35 U.S.C. 154(b) by 773 days.

(21) Appl. No.: 16/944,938

(22) Filed: Jul. 31, 2020

(65) Prior Publication Data

US 2022/0034111 A1 Feb. 3, 2022

(51) Int. Cl.

| | |
|---|---|
| ***E04G 21/30*** | (2006.01) |
| ***E04G 15/04*** | (2006.01) |
| ***E04G 21/14*** | (2006.01) |
| ***E04B 1/04*** | (2006.01) |
| *E04G 21/16* | (2006.01) |

(52) U.S. Cl.

CPC ..... *E04G 21/30* (2013.01); *E04B 1/04* (2013.01); *E04G 21/147* (2013.01); *E04G 15/04* (2013.01); *E04G 21/142* (2013.01); *E04G 21/162* (2013.01)

(58) Field of Classification Search

CPC ..... E04B 1/04; E04G 21/30; E04G 21/147; E04G 21/142; E04G 15/04; E04G 21/185; E04G 21/162

See application file for complete search history.

(56) References Cited

U.S. PATENT DOCUMENTS

| | | | | |
|---|---|---|---|---|
| 5,528,867 | A | 6/1996 | Thompson | |
| 7,222,460 | B2 | 5/2007 | Francies, III et al. | |
| D558,365 | S | 12/2007 | Thompson | |
| 7,836,645 | B1 * | 11/2010 | Zierer | E04G 21/3252 52/220.8 |
| 2002/0195537 | A1 * | 12/2002 | Kelly | B29C 45/0055 249/91 |
| 2003/0140576 | A1 * | 7/2003 | Sanftleben | E04G 15/04 52/125.4 |
| 2019/0284815 | A1 * | 9/2019 | Schlipper | E04G 21/32 |

FOREIGN PATENT DOCUMENTS

| | | | | |
|---|---|---|---|---|
| CN | 103958802 A | * | 7/2014 | E04G 21/125 |
| DE | 202007010509 U1 | * | 1/2009 | B28B 23/005 |
| DE | 102020203116 A1 | * | 9/2021 | E04G 21/126 |
| EP | 2224075 A2 | * | 9/2010 | E04G 21/125 |
| WO | WO-2014037624 A1 | * | 3/2014 | E03F 5/0407 |
| WO | WO-2014088913 A1 | * | 6/2014 | E04B 1/4107 |
| WO | WO-2018157212 A1 | * | 9/2018 | E04G 21/185 |

* cited by examiner

*Primary Examiner* — Phi D A

(74) *Attorney, Agent, or Firm* — Miller Law Group, PLLC

(57) ABSTRACT

An oval cover member is formed of high density polyethylene and sized to cover a pocket in which a lift member is secured to a pre-cast concrete structural member. The cover member can be secured to the lift member by a cable tie threaded through the opening of a first protrusion, back through a smaller opening in a second protrusion and pulled to draw the cover member tightly against the concrete structural member. The opposing protrusions form a valley therebetween for the positioning of the lift member. The size of the smaller opening in the second protrusion is too small for the passage of the head of the cable tie, enabling the cover member to be tightly secured to the lift member. A peripheral channel in the cover member can receive a gasket or adhesive that can seal the cover member against the surface of the concrete structural member.

19 Claims, 10 Drawing Sheets

Fig. 6
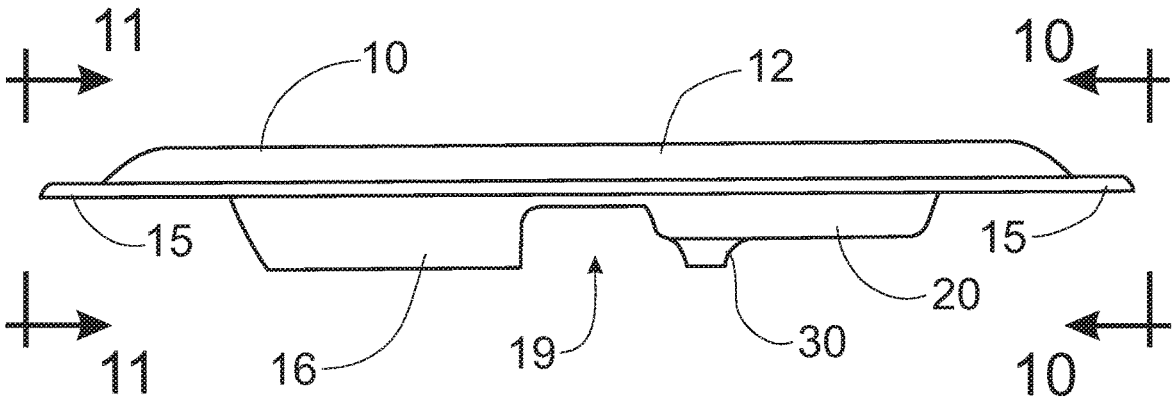
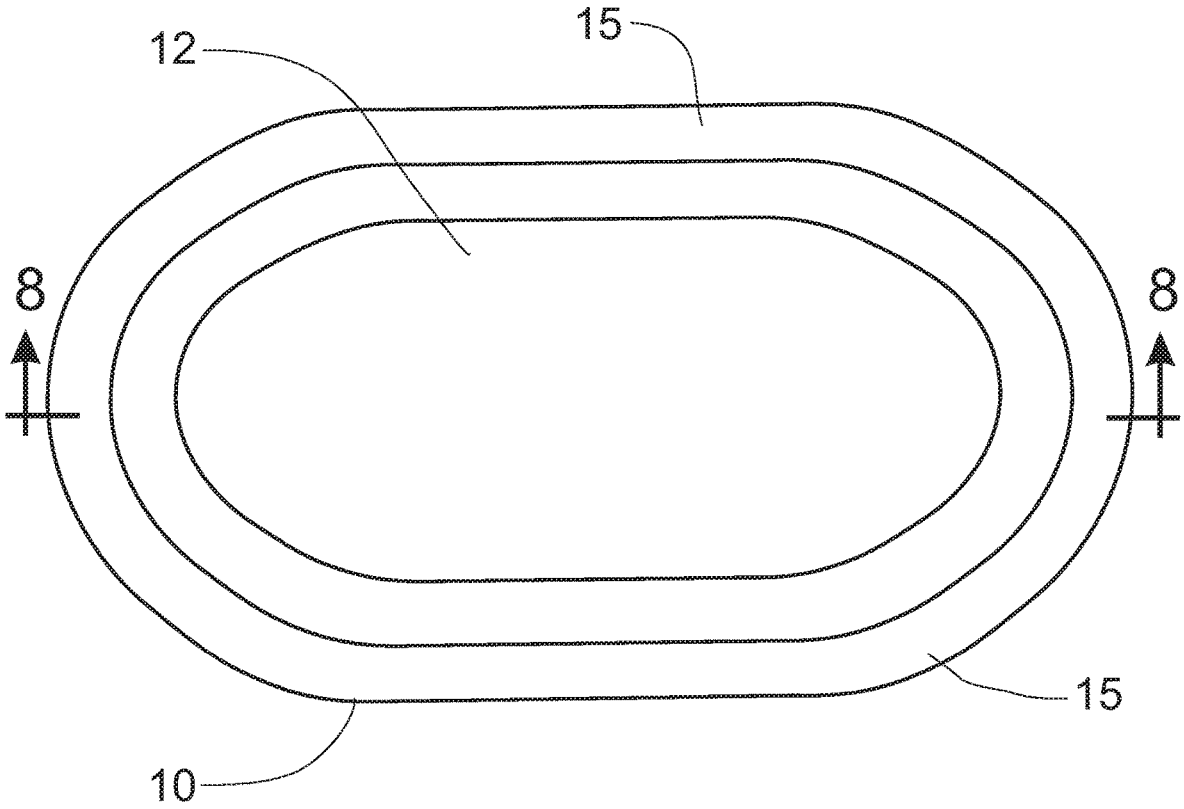
Fig. 7

Fig. 8
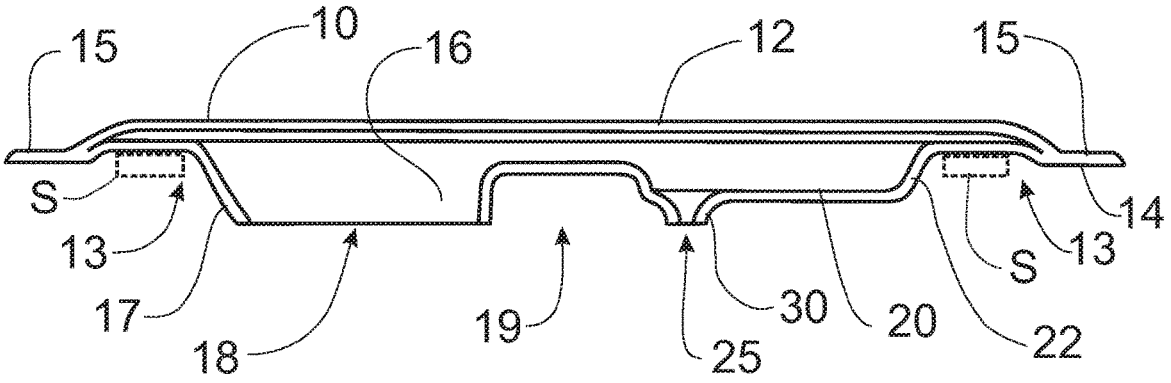
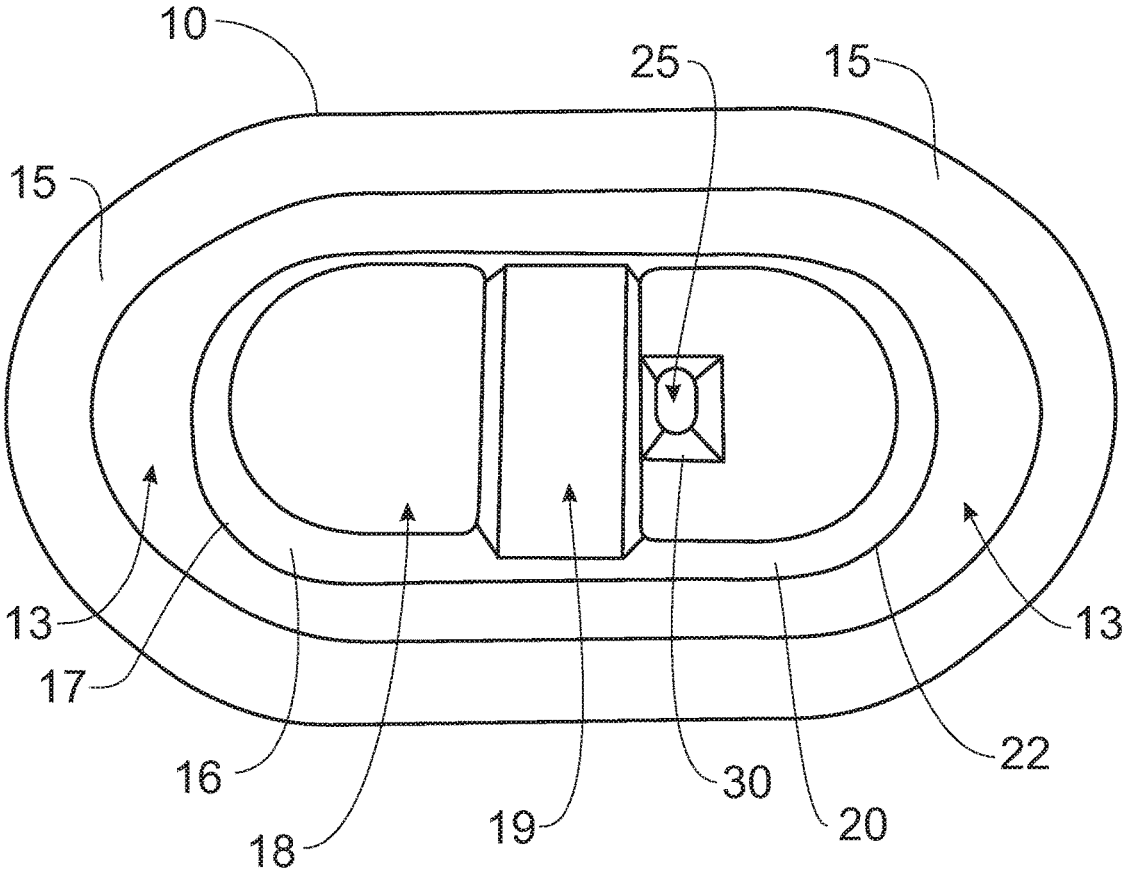
Fig. 9

Fig. 10
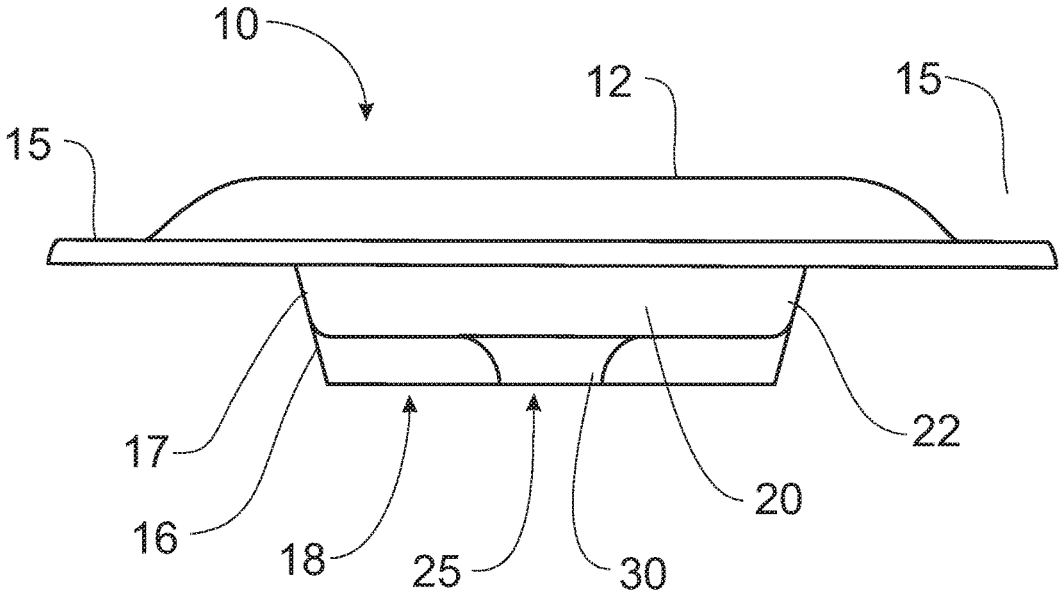
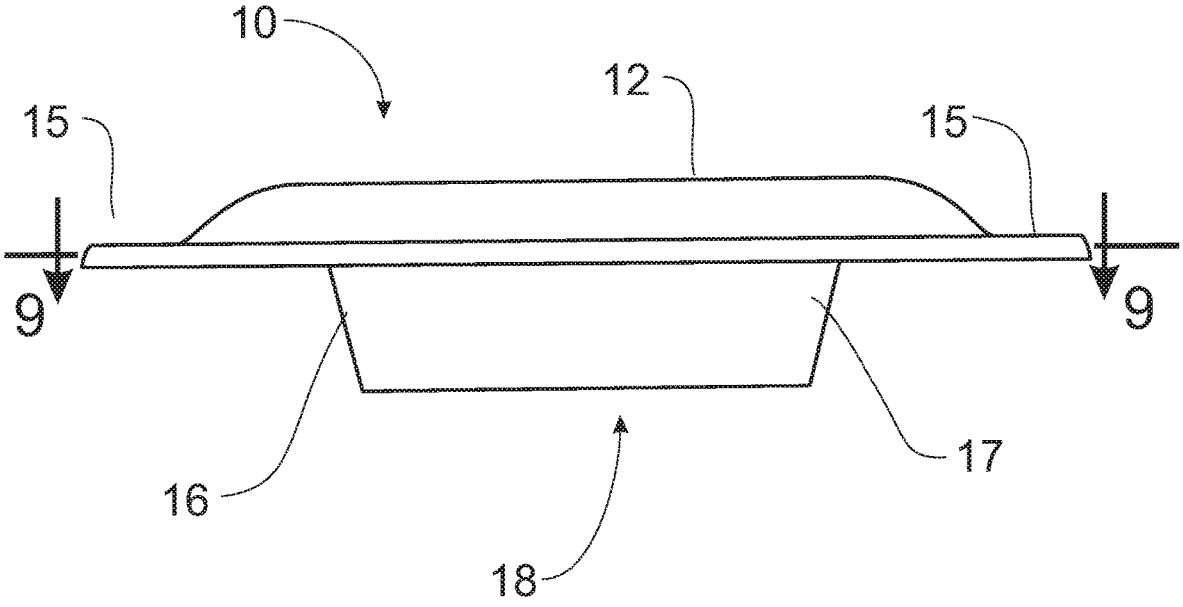
Fig. 11

OVAL COVER MEMBER FOR PRE-CAST CONCRETE LIFT HOOK

CROSS-REFERENCE TO RELATED APPLICATIONS

This application claims domestic priority from U.S. Provisional Patent Application Ser. No. 62/892,157, filed on Aug. 27, 2019, the content of which is hereby incorporated by reference.

FIELD OF THE INVENTION

This invention relates generally to cover member that is placed on a pre-cast concrete structural member to cover an access opening for a lift hook or lift bar and, more particularly, to a cover member that has a secure attachment device that enhances the retention of the cover member on the pre-cast concrete structural member.

BACKGROUND OF THE INVENTION

Pre-cast concrete structural members are typically formed remotely from the site on which the structural member is to be used utilizing concrete and reinforcing steel hooks and other members. Such pre-cast concrete structural members are used in foundations, buildings, and parking garages, to provide examples. These pre-cast concrete structural members are large and heavy members, and have to be lifted from the form unto a large truck or other transport device to be moved to the job site. Once at the job site, the pre-cast structural member has to be lifted off the transport device and installed at the proper location for utilization. Lifting and placing pre-cast concrete structural members typically requires a crane that is connected to a lift hook or lift bar, sometimes referred to as the hook or the anchor, which is embedded into the pre-cast structural member below the surface of the member. The pre-cast member can then be lifted and moved as needed. The lift hook or lift bar is usually located in a pocket formed for the exposure of lift hook or lift bar. Once the pre-cast structural member is installed at the job site, covering the pocket is desired to prevent accumulation of debris, moisture, bird's nests, etc., in the exposed pocket.

Cover members have been developed to be placed on top of the open pocket, resting on the outer surface of the pre-cast structural member and covering the pocket from exposure. One such cover member can be found in U.S. Design Pat. No. D558,365, granted to Harry A. Thompson, the Applicant herein, on Dec. 25, 2007. This particular cover member is sized to cover conventional pockets with a pair of protrusions that project into the pocket with a valley between the protrusions that receives the top portion of the lift bar. This cover member has an oval circumferential flange that rests on the exterior surface of the pre-cast structural member around the pocket formed for access to the lift bar. The circumferential flange is secured to the exterior surface of the pre-cast structural member by an adhesive. One possible problem with this cover member configuration is that the adhesive securing the circumferential flange to the exterior surface of the pre-cast structural member can weaken with age and exposure to the elements to allow the cover member to be removed or even simply fall off the structural member, exposing the pocket.

U.S. Pat. No. 5,528,867, granted to Harry A. Thompson, the Applicant herein, on Jun. 25, 1996, discloses a different configuration of a cover member in which the hollow vessel is formed with an inwardly tapered aperture that incorporates slits that allow expansion of the hollow vessel to encompass the hook head and be secured thereon. U.S. Pat. No. 7,222,460, granted to Sidney E. Francies III, et al., on May 29, 2007, discloses yet a different configuration of a cover member intended to be secured on an anchor or hook members used for lifting the pre-cast concrete structural member. In the Francies patent the central portion of the underside of the cover member is formed with a receiver having a plurality of flexible fins that yield around the anchor or hook members and secure the cover member to the anchor or hook members. Installation is done by pressing the receiver over the anchor or hook members and pressing downwardly onto the structural member until the flange engages the exterior surface of the structural member. In this manner, the cover member keeps the pocket from being exposed externally.

It is desirable to provide a cover member that incorporates a fastening device that firmly secures the cover member to the hook or anchor residing in a pocket formed in a pre-cast concrete structural member.

SUMMARY OF THE INVENTION

It is an object of this invention to overcome the disadvantages of the prior art by providing a cover member for use on a pre-cast concrete structural member that firmly secures to the anchor within a pocket covered by the cover member.

It is another object of this invention that the oval cover member can be secured to the anchor within the pocket by a cable tie.

It is a feature of this invention that the cover member is formed with an exterior dome portion made of high density polyethylene and covers the lift anchor formed within a pocket of the pre-cast structural member.

It is another feature of this invention that the underside of the cover member is formed with a pair of protrusions forming a valley therebetween.

It is an advantage of this invention that the protrusions are formed to be positioned on opposing sides of the anchor.

It is another advantage of this invention that the anchor can be positioned within the valley between the opposing protrusions.

It is still another feature of this invention that the first protrusion is formed with an opening of sufficient size to permit the placement of a cable tie into the opening.

It is yet another feature of this invention that the second protrusion is formed with an opening for the passage of the body portion of the cable tie.

It is still another advantage of this invention that the opening in the second protrusion is not large enough to permit the passage of the head of the cable tie therethrough.

It is a further feature of this invention that the cover member is formed with a peripheral channel on the underside thereof for the placement of a gasket to be seated within said channel to seal the opening.

It is still another object of this invention to provide a shaped cover member for covering and sealing a pocket in a pre-cast concrete structural member concealing a lift member in which the cover member can be secured to the lift member with a cable tie, which could be any shape that covers the pocket including oval, round or other shapes and in which the cover member is inexpensive in use, carefree of maintenance and simple and effective in utilization.

These and other objects, features and advantages are accomplished according to the instant invention by providing an oval cover member formed of high density polyethylene and sized to cover a pocket in which a lift member is secured in a pre-cast concrete structural member. The cover member can be secured to the lift member by a cable tie that is threaded through the opening of a first protrusion and back through a smaller opening in a second protrusion and pulled to draw the cover member tightly against the concrete structural member. The opposing protrusions form a valley therebetween for the positioning of the lift member. The smaller opening in the second protrusion is sized to be too small for the passage of the head of the cable tie to enable the cover member to be tightly secured to the lift member. The cover member is formed with a peripheral channel in which a gasket or adhesive can be placed to seal the cover member against the surface of the concrete structural member.

BRIEF DESCRIPTION OF THE DRAWINGS

The advantages of this invention will become apparent upon consideration of the following detailed disclosure of the invention, especially when taken in conjunction with the accompanying drawings wherein:

FIG. 6 is a side elevational view of the cover member incorporating the principles of the instant invention;

FIG. 7 is a top plan view of the cover member shown in FIG. 6;

FIG. 8 is a cross-sectional view of the cover member taken along lines 8-8 in FIG. 7;

FIG. 9 is a view taken along lines 9-9 in FIG. 11 to depict the bottom portion of the cover member shown in FIG. 6 with the dome portion removed;

FIG. 10 is a right side elevational view of the cover member corresponding to lines 10-10 in FIG. 6;

FIG. 11 is a left side elevational view of the cover member corresponding to lines 11-11 in FIG. 6;

DETAILED DESCRIPTION OF THE PREFERRED EMBODIMENTS

Figure 12:
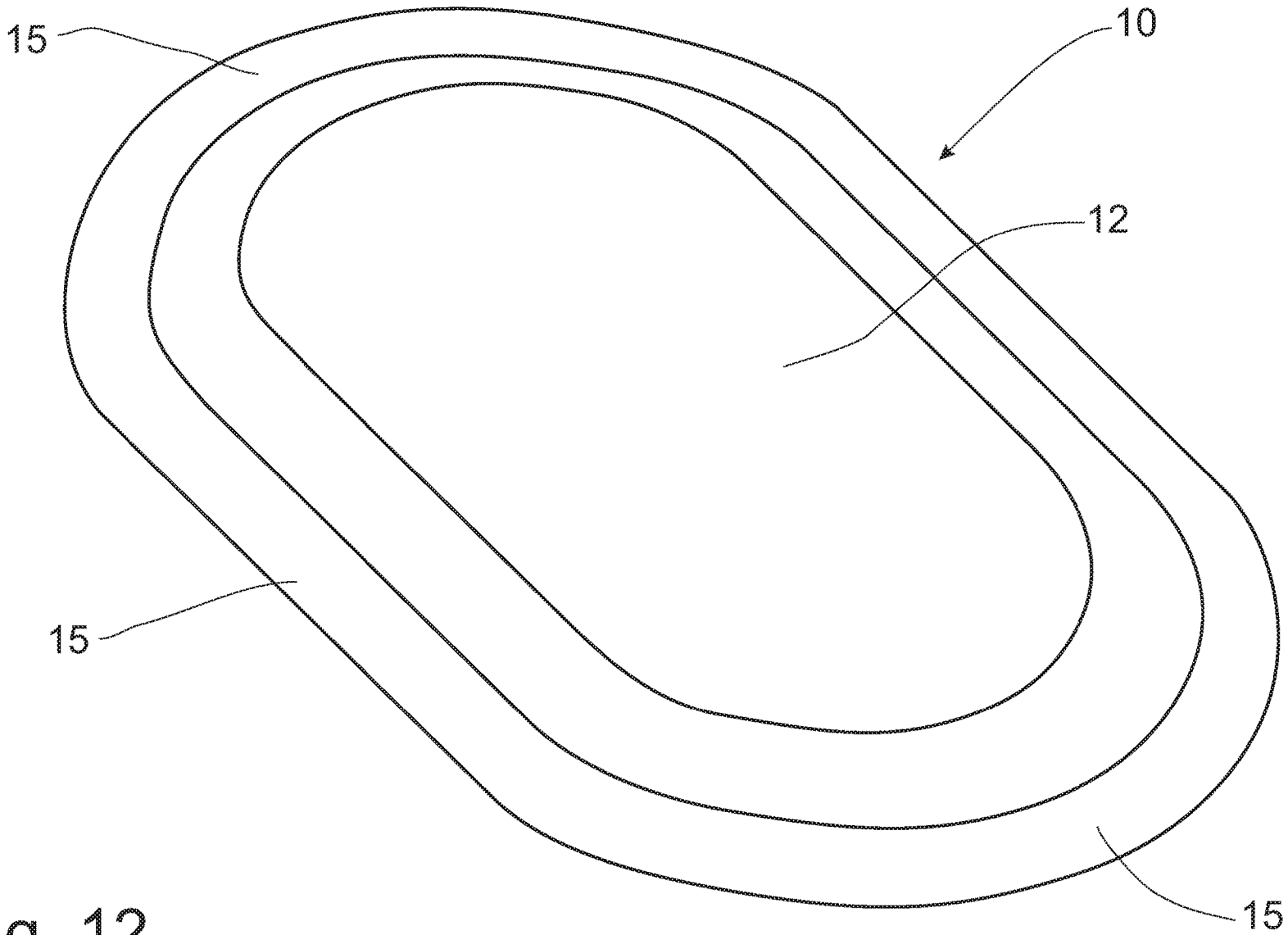
FIG. 12 is an enlarged perspective view showing the top surface of the cover member shown in FIG. 6.
Figure 13:
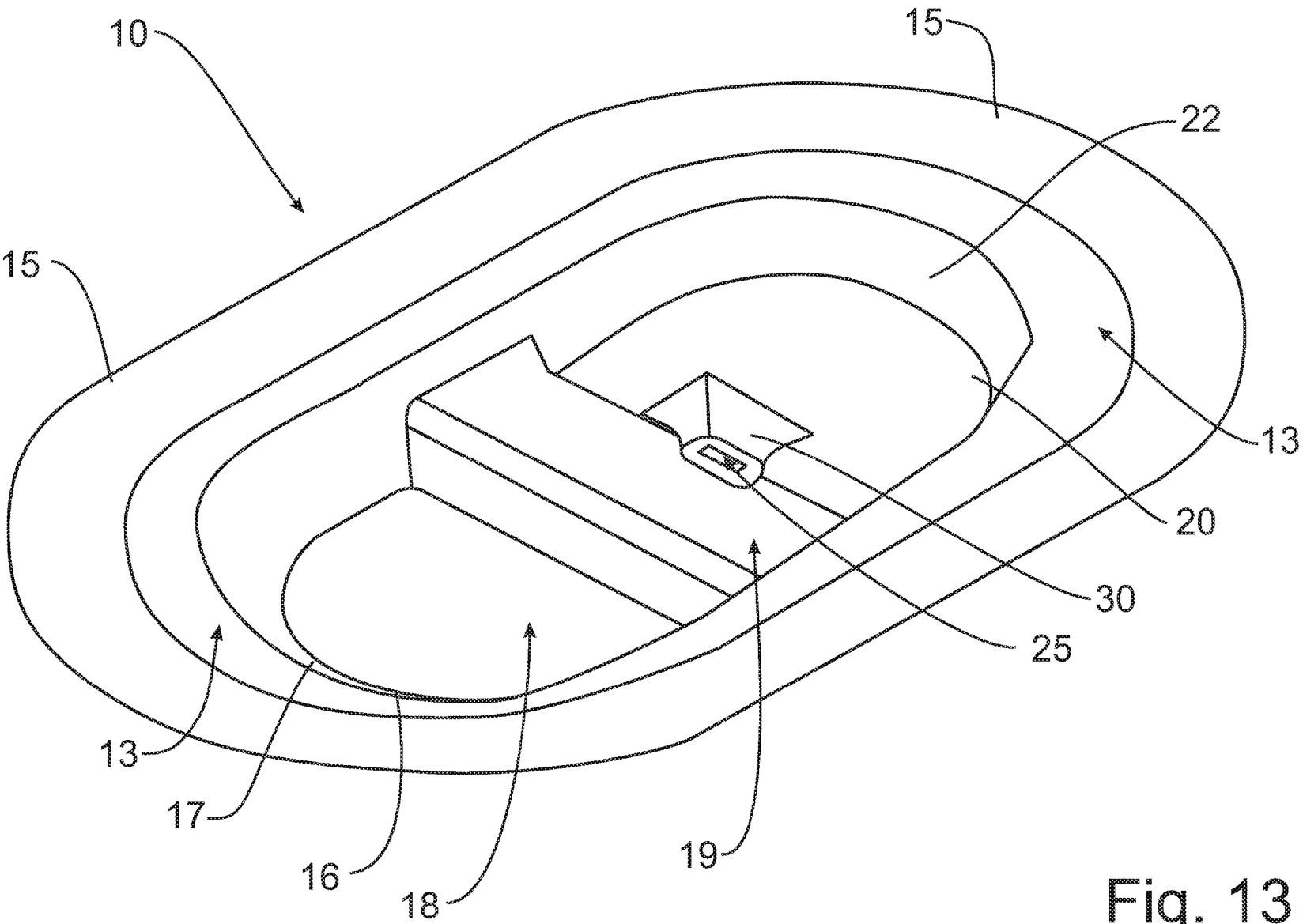
FIG. 13 is an enlarged perspective showing the bottom surface of the cover member shown in FIG. 6.

Referring now to FIGS. 6-13, a cover member incorporating the principles of the instant invention and being designed to be placed over an access pocket formed in a pre-cast concrete structural member to access a lift hook or lift bar, sometimes referred to as a hook or an anchor, to close the pocket from assess from the exterior of the structural member, and being securely connected directly to the anchor within the pocket to secure the cover member to the structural member.

The cover member 10 is preferably manufactured from a high density polyethylene (HDPE) material that may incorporate a color concentrate and an ultraviolet inhibitor, as is known in the art. One skilled in the art will understand that the HDPE material is impervious to water and, thus, can prevent the entrance of moisture into the pocket 2 of the pre-cast structural member 1 which helps to limit any deterioration of the anchor. Furthermore, the ultraviolet inhibitor limits exposure of the anchor to ultraviolet rays which can further deteriorate the anchor.

The cover member 10 is formed in a shape that corresponds to shape of the pocket in which the anchor is exposed for engagement by lifting devices (not shown), which typically is an elongated oval shape, but could be other suitable shapes capable of covering the pocket in which the lift hook is located. The top surface 12 of the cover member, which is exposed to the atmosphere when installed onto the exterior surface of the pre-cast concrete structural member, as will be described in greater detail below, is preferable a smooth, flat dome elevated above a peripheral flange 15 extending around the perimeter of the cover member 10. The elevation of the top surface 12 above the peripheral flange 15 provides some strength in the cover member 10 to resist inwardly directed forces, such as from a person stepping on the cover member 10. As will be described in greater detail below, the dome 12 can be molded into substantially any ornamental shape as desired so long as the dome 12 or top surface provides a passage for the cable tie to fit between the inside top surface of the valley 19 and shaped top surface 12.

Similar to the cover member disclosed in U.S. Design Pat. No. D558,365, granted to Harry A. Thompson on Dec. 25, 2007, the underside of the cover member 10 is formed with a pair of integral protrusions 16, 20 that project below the surface of the peripheral flange 15 and extend into the void formed by the pocket 2 in the pre-cast concrete structure member 1. The cover member 10 defines a valley 19 between the two protrusions 16, 20, in which the anchor 5 may reside if appropriately positioned within the pocket 2. As will be described in greater detail below, the first protrusion 16 has a downwardly extending, sloped vertical wall 17 that terminates at a level that is spaced below the corresponding vertically sloped wall 22 of the second protrusion 20. The first protrusion 16 is formed with a large opening 18 defined by the terminus of the first vertical wall 17. The drawing figures depict this opening 18 as encompassing the entire lower portion of the first protrusion 16, but this opening 18 can be significantly smaller, so long as adequate access into the protrusion 16 is provided by the opening 18.

The second protrusion 20 has a closed surface, except for an access opening 25 formed at an interior position of the second protrusion 20 next to the valley 19. The closed surface of the second protrusion 20 incorporates the access opening 25 formed as a third protrusion 30 extending downwardly from the closed surface of the second protrusion 20 and having the access opening 25 at the end of the third protrusion 30 positioned at approximately the same level as the opening 18 in the first protrusion 16. The underside 14 of the peripheral flange 15 presents a flat surface around the periphery of the cover member 10 that is intended to engage the exterior surface 3 of the pre-cast concrete structural member 1 around the pocket 2. Accordingly, the peripheral flange 15 of the cover member 10 can be sealed against the exterior surface 3 of the structural member 1 by an optional elastomeric gasket S, depicted in FIG. 8 in phantom, or an appropriate adhesive (not shown).

Figure 1:
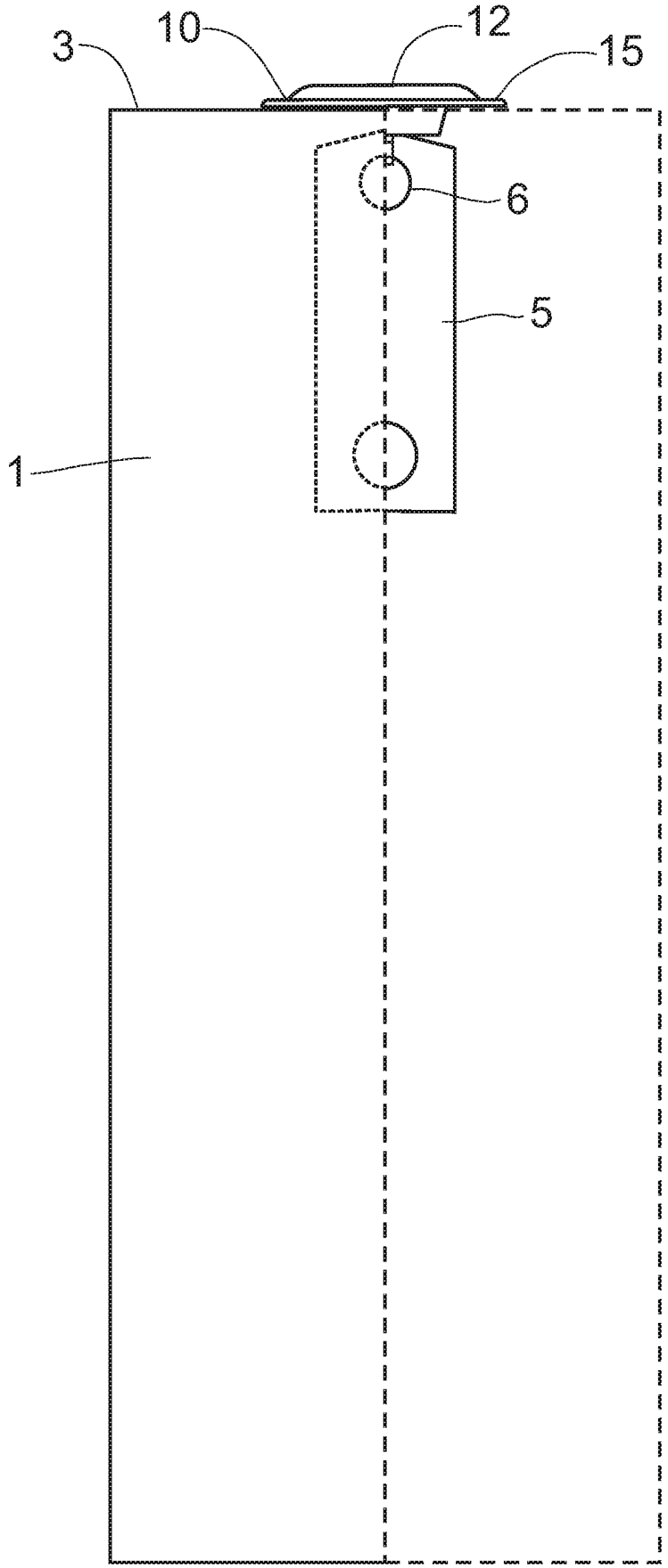
FIG. 1 is an elevational view of a representative pre-cast concrete structural member having half of the structural member removed for purposes of clarity in viewing the anchor formed in a pocket at the top of the structural member, the removed portion of the structural member being shown in dashed lines, and the half of the anchor embedded in the displayed half of the structural member also being shown in dotted lines.
Figure 2:
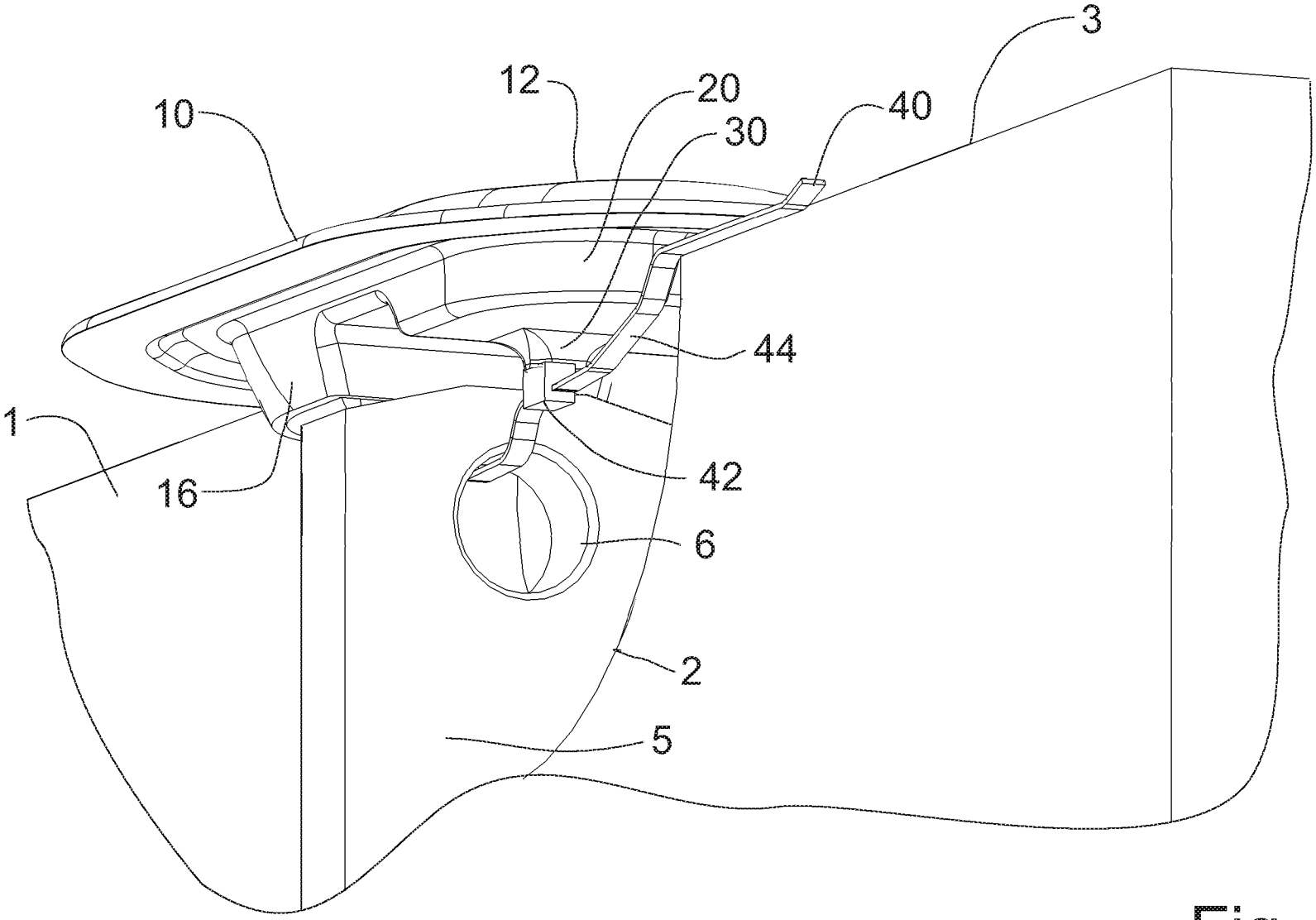
FIG. 2 is a perspective view of the anchor embedded in the structural member with the cover member securely connected to the anchor and positioned to cover the pocket, according to the principles of the instant invention.
Figure 3:
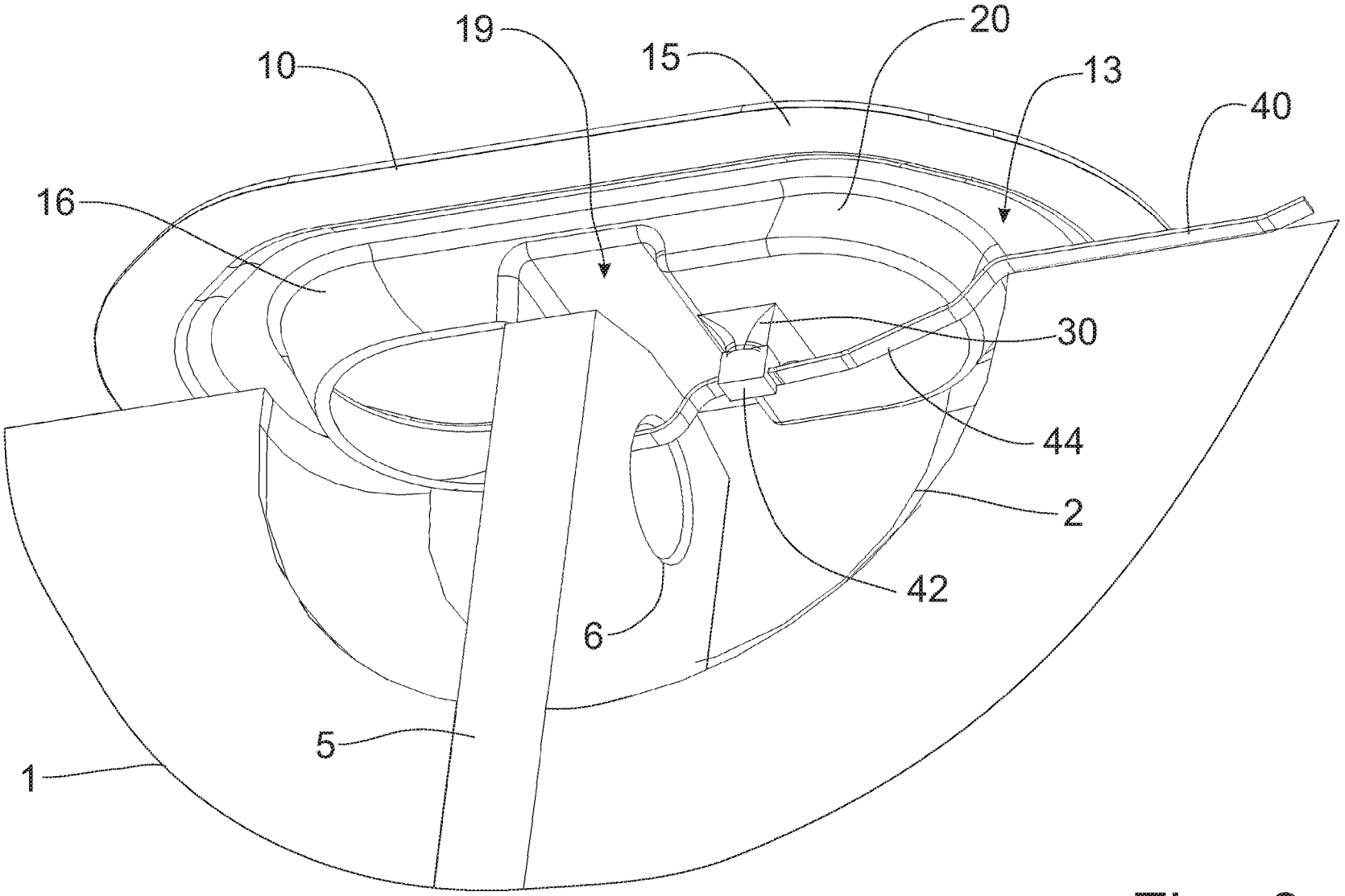
FIG. 3 is another perspective view of the anchor embedded in the structural member with the cover member securely connected to the anchor and positioned to cover the pocket, according to the principles of the instant invention.
Figure 4:
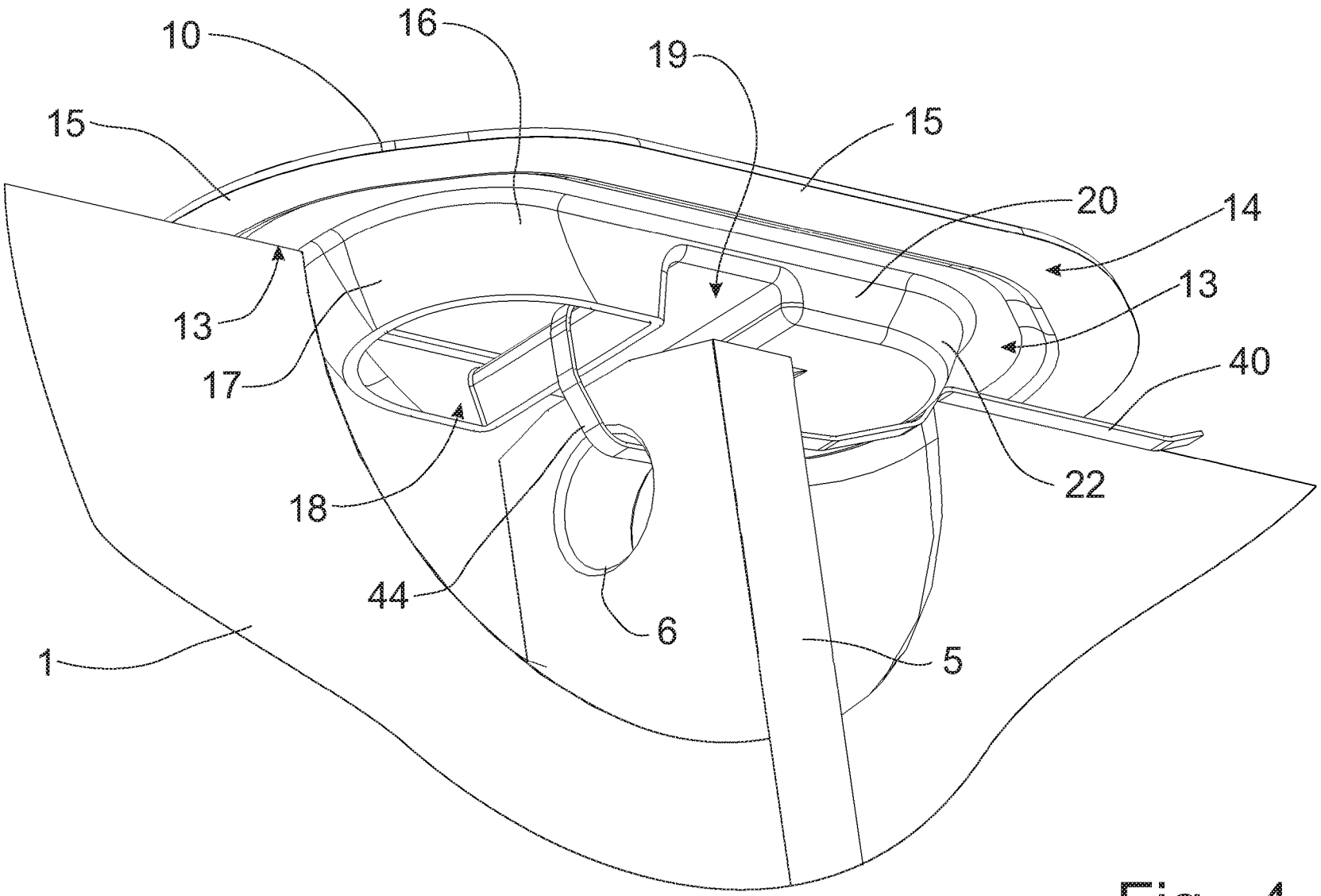
FIG. 4 is still another perspective view of the anchor embedded in the structural member with the cover member securely connected to the anchor and positioned to cover the pocket, according to the principles of the instant invention.
Figure 5:
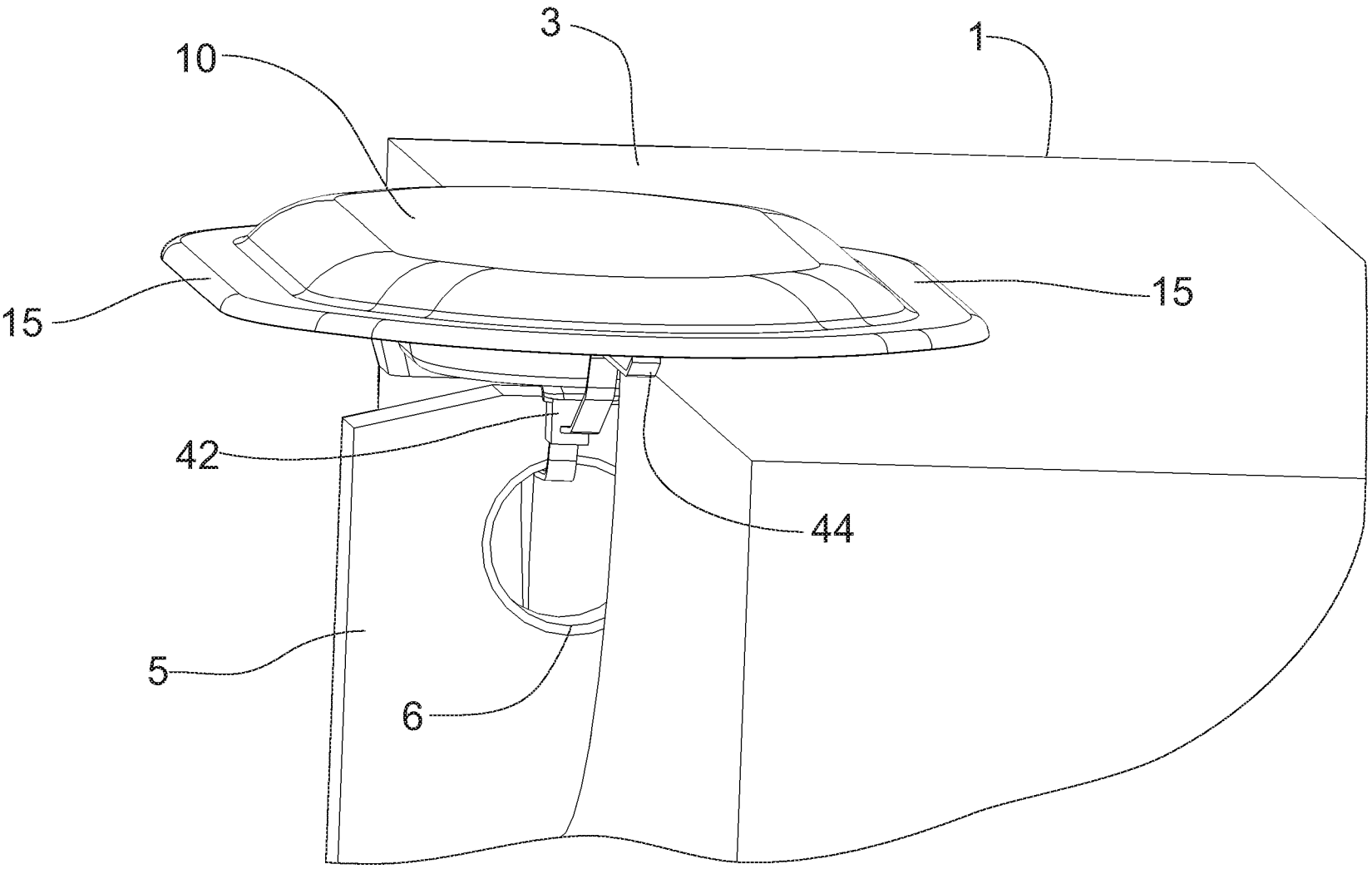
FIG. 5 is yet another perspective view of the anchor embedded in the structural member with the cover member securely connected to the anchor and positioned to cover the pocket, according to the principles of the instant invention.

Referring now to FIGS. 1-5, a representative pre-cast concrete structural member 1 having an anchor 5 embedded therein and having a pocket 2 formed around the anchor 5 to permit convenient access to the anchor 5 for lifting the structural member 1 for movement and for installation at the job site. The anchor 5 is formed with a hole 6 therein near the top surface of the anchor exposed within the void formed by the pocket 2. The fastening device 40 connecting the cover member 10 to the anchor 5 is best seen in FIGS. 2-5. The fastening device 40 is preferably a flexible cable tie that has a fastening head 42 and an elongated body 44 that can be engaged within the fastening head 42 which is conventionally operable to allow the passage of the elongated body 44 through the fastening head 42 in one direction only. Once the elongate body 44 is passed through the fastening head 42 the elongated body 44 cannot be retracted back through the fastening head 42. Other forms of a fastening device 40 may be found to be operatively acceptable, but the feature of the cable tie 40 that prevents the elongated body 44 from retracting out of the fastening head 42 allows the cable tie 40 to be pulled tightly to firmly secure the cover member 10 to the anchor 5.

One skilled in the art will recognize that the size of the access opening 25 at the end of the third protrusion 30 must be smaller than the size of the fastening head 42 of the cable tie 40. This size relationship prevents the fastening head 42 from being pulled into the third protrusion 30, which would result is a loose connection between the cover member 10 and the anchor 5. As noted above, the size of the opening 18 in the first protrusion 16 requires that the installer of the cover member 10 be able to grasp the loose end of the elongated body 44 of the cable tie 40 so that the elongated body 44 can be directed into engagement with the fastening head 42. The elongated body 44 of the cable tie 40 will preferably have sufficient length to encircle the valley 19 by first passing into the third protrusion 30, then out of the first protrusion 10, through the opening 6 at the top of the anchor 5, then through the fastening head 42 and be extended past the peripheral flange 15 to be operatively accessed along the exterior surface 3 of the pre-cast concrete structural member 1.

In operation, the cover member 10 is installed over the pocket 2 after the pre-cast structural member 1 has been properly installed at the job site. From this point in time, but before the completion of the project for which the pre-cast concrete structural member has been installed, the cover member 10 can be installed over the pocket 2 exposing the anchor 5 for engagement with a lifting mechanism, such as a crane. To affect the installation, the cover member 10 is fitted with the fastening device 40, preferably a large cable tie 40, by passing the elongated body 44 of the cable tie 40 through the access opening 25 at the bottom of the third protrusion 30. The installer will then reach into the opening 18 at the end of the first protrusion 16 to redirect the end of the elongated body 44 out of the first protrusion 16 and then back through the hole 6 at the top of the exposed anchor 5.

The installer then inserts the end of the elongated body 44 through the fastening head 42 and pulls the elongated body 44 far enough through the fastening head 42 that the distal end of the body 44 can be positioned past the peripheral flange 15 of the cover member 10. At this point, the cover member 10 is loosely fitted to the anchor 5. In the situation where the installer desires to install an elastomeric seal S, the seal S can be installed within a small peripheral channel 13 around the circumference of the cover member 10 on the inside of the peripheral flange 15, as is shown in phantom in FIG. 8. In the situations where the elastomeric seal S is in the form of an appropriately shaped and sized oval, the seal S would likely have to be installed on the cover member 10 before the cable tie 40 was loosely fitted on the anchor 5.

Optionally, the installer may want to place adhesive on the underside of the peripheral flange 15, whether or not an elastomeric seal (not shown) is installed on the cover member 10, as noted above. In this event, the installer will apply the adhesive to the underside of the peripheral flange 15 and/or on the corresponding exterior surface 3 of the pre-cast concrete structural member 1 before completing the manipulating of the cable tie 40. Once the installer is ready to complete the affixation of the cover member 10 over the pocket 2, the installer grasps the distal end of the elongated body 44 extending past the underside of the peripheral flange 15, and pulls the distal end of the elongated body 44 until the cable tie 40 is tight. The pulling of the distal end of the elongated body 44 draws the fastening head 42 into a tight engagement with the lower end of the third protrusion 30 as the elongated body 44 advances through the fastening head 42. The end result is best seen in FIGS. 2-5 with the peripheral flange 15 being drawn onto the corresponding exterior surface 3 of the pre-cast concrete structural member 1 and the cover member securely fastened to the anchor 5. Once the cover member 10 is properly seated over the pocket 2, the end of the elongated body 44 extending beyond the peripheral flange 15 can be cut off and discarded.

One skilled in the art will recognize that once the cover member 10 is installed and secured to the anchor 5, as described above, the cover member 10 cannot be conveniently removed. Removal of the cover member 10 would best be accomplished by cutting the top surface dome 12 of the cover member 10 along the minor axis of the oval shape, e.g. above the position of the valley 19. An appropriate cut through the top surface dome 12 will expose the cable tie 40 passing over the valley 19 whereupon the cable tie 40 can be severed and the connection of the cover member 10 to the anchor 5 disrupted. Unless adhesive was used on the underside of the peripheral flange 15, the cover member 10 should then be easily removed. If adhesive had been applied at the time of installation, then the connection between the peripheral flange 15 and the corresponding exterior surface 3 of the structural member would have to be broken, which would likely result in further destruction of the cover member 10.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A cover member for engaging an anchor in a pre-cast concrete structural member to cover an access pocket depressed into an exterior surface of the pre-cast concrete structural member exposing the anchor for utilization, comprising:

an upper surface including a central dome portion surrounded by a peripheral flange extending around a circumference of the central dome;

a lower surface formed with first and second protrusions positioned to extend downwardly into said access pocket when installed on said pre-cast concrete structural member, said first and second protrusions having a valley formed therebetween;

said first protrusion having a first generally vertical wall terminating in a lower edge at a first level defined as a first dimension from said peripheral flange, said lower edge at least partially defining an opening permitting access internally of said first protrusion;

said second protrusion having a second generally vertical wall terminating in a lower edge at a second level defined as a second dimension from said peripheral flange, said second dimension being smaller than said first dimension; and a third protrusion supported on said second protrusion and extending downwardly from said second level to said first level, said third protrusion including an access opening smaller than said opening in said first protrusion.

2. The cover member of claim 1 wherein said cover member is cooperable with a fastener tie member having a fastening head and an elongated body engagable through said fastening head.

3. The cover member of claim 2 wherein the size of said access opening in said third protrusion is smaller than said fastening head such that said fastening head will not pass through said access opening in said third protrusion.

4. The cover member of claim 3 wherein said elongated body has sufficient length to pass through said access opening in said third protrusion, over the top of said valley, outward through the opening in said second protrusion, through an opening in said anchor, through said fastening head, and underneath said peripheral flange.

5. The cover member of claim 4 wherein said lower surface of said cover member includes a peripheral channel formed adjacent to said peripheral flange for the application of an elastomeric seal to be compressed between said cover member and said exterior surface of said pre-cast concrete structural member around said access pocket.

6. The cover member of claim 5 wherein an underside surface of said peripheral flange is planar in order to mate against a corresponding portion of the exterior surface of said per-cast concrete structural member.

7. The cover member of claim 6 wherein said cover member is formed from high density polyethylene material.

8. A method of connecting a cover member to an exposed anchor within an access pocket of a pre-cast concrete structural member, said anchor being embedded in said pre-cast concrete structural member below an exterior surface of said pre-cast concrete structural member adjacent said access pocket, comprising the steps of:

providing a cover member having a central dome surrounded by a peripheral flange, a first protrusion projecting into said access pocket at one end of said cover member and defining an opening for accessing an interior portion of said first protrusion, a second protrusion projecting into said access pocket at an opposing end of said cover member and having a closed lower portion, a third protrusion projecting downwardly into said access pocket from said closed lower portion of said second protrusion and defining an access opening that opens into an interior space within said second and third protrusions, said first and second protrusions forming a valley therebetween;

also providing a cable tie having an elongated body and a fastening head operable to receive said elongated body therethrough for passage in one direction;

threading said elongated body of said cable tie into said access opening of said third protrusion for passage through said second and third protrusions and above said valley;

extracting said elongated body of said cable tie from within said first protrusion and outwardly through said opening in said first protrusion;

extending said elongated body of said cable tie through an opening in said anchor and into engagement with said fastening head of said cable tie; and pulling said elongated body through said fastening head until said cable tie becomes tight and said peripheral flange is engaged with said exterior surface of said pre-cast concrete structural member around said access pocket.

9. The method of claim 8 further comprising the step of placing an elastomeric seal in a peripheral channel adjacent to and interiorly of said peripheral flange before said pulling step.

10. The method of claim 8 further comprising the step of placing adhesive on an underside surface of said peripheral flange before said pulling step.

11. The method of claim 10 further comprising the step of placing an elastomeric seal in a peripheral channel adjacent to and interiorly of said peripheral flange before said pulling step.

12. The method of claim 8 wherein said access opening in said third protrusion is formed to be smaller in size than said fastening head of said cable tie so that said fastening head cannot pass through said access opening.

13. The method of claim 12 wherein said opening in said first protrusion is larger than said access opening in said third protrusion.

14. A cover member for engaging an anchor in a pre-cast concrete structural member to cover an access pocket depressed into an exterior surface of the pre-cast concrete structural member exposing the anchor for utilization, comprising:

a central dome surrounded by a peripheral flange;

a first protrusion formed to project into said access pocket at one end of said cover member and defining an opening for accessing an interior portion of said first protrusion;

a second protrusion formed to project into said access pocket at an opposing end of said cover member and having a closed lower portion;

a third protrusion formed to project downwardly into said access pocket from said closed lower portion of said second protrusion and defining an access opening that opens into an interior space within said second and third protrusions;

a valley formed between said first and second protrusions; and a cable tie having an elongated body and a fastening head operable to receive said elongated body therethrough for passage in one direction, said cable tie passing through said access opening in said third protrusion, through said interior space in said second and third protrusions, above said valley, down through said first protrusion, exiting said opening in said first protrusion, through an opening in said anchor, and into engagement with said fastening head, said elongated body being pulled through said fastening head until said cable tie becomes tight and said peripheral flange is engaged against said exterior surface of said pre-cast concrete structural member around said access pocket.

15. The cover member of claim 14 further comprising:

an elastomeric seal seated within a peripheral channel located adjacent to and interiorly of said peripheral flange in order to compress between said cover member and said exterior surface of said pre-cast structural member.

16. The cover member of claim 14 wherein the size of said access opening in said third protrusion is smaller than said fastening head such that said fastening head will not pass through said access opening in said third protrusion.

17. The cover member of claim 16 wherein said elongated body has sufficient length to extend outwardly of said peripheral flange to permit engagement with said elongated body to pull said cable tie tight.

18. The cover member of claim 17 wherein said cover member is formed from high density polyethylene material.

19. The cover member of claim 18 wherein an underside surface of said peripheral flange is planar in order to mate against a corresponding portion of the exterior surface of said per-cast concrete structural member and to accept an application of adhesive for engagement between said peripheral flange and said exterior surface of said pre-cast concrete structural member.

* * * * *